US010047525B2

(12) United States Patent
Gehring et al.

(10) Patent No.: US 10,047,525 B2
(45) Date of Patent: Aug. 14, 2018

(54) METHOD OF FORMING A BUILDING STRUCTURE

(71) Applicant: Summit Stone Solutions, LLC, Sandy, UT (US)

(72) Inventors: Steven Gehring, Sandy, UT (US); Donald P. Williams, Taylorsville, UT (US)

(73) Assignee: SUMMIT STONE SOLUTIONS, LLC, Sandy, UT (US)

( * ) Notice: Subject to any disclaimer, the term of this patent is extended or adjusted under 35 U.S.C. 154(b) by 0 days.

(21) Appl. No.: 15/158,480

(22) Filed: May 18, 2016

(65) Prior Publication Data

US 2017/0030073 A1 Feb. 2, 2017

Related U.S. Application Data

(60) Provisional application No. 62/198,035, filed on Jul. 28, 2015.

(51) Int. Cl.
*E04B 2/00* (2006.01)
*E04F 13/08* (2006.01)

(52) U.S. Cl.
CPC ..... *E04F 13/0875* (2013.01); *E04F 13/0862* (2013.01)

(58) Field of Classification Search
CPC ..... E04B 1/762; E04B 1/80; E04B 1/7629; E04B 1/7625
See application file for complete search history.

(56) References Cited

U.S. PATENT DOCUMENTS

| | | | | |
|---|---|---|---|---|
| 1,986,739 | A | 1/1935 | Mitte | |
| 3,621,625 | A | 11/1971 | Medow | |
| 3,968,610 | A | 7/1976 | Medow | |
| 4,944,416 | A * | 7/1990 | Petersen | A47F 5/0846 211/87.01 |
| 5,624,615 | A | 4/1997 | Sandorff | |
| 5,685,523 | A * | 11/1997 | Sugiyama | E04H 17/16 256/19 |
| 5,816,005 | A | 10/1998 | Han | |
| 5,836,123 | A | 11/1998 | Gulino | |
| 6,023,892 | A * | 2/2000 | Sourlis | E04B 1/644 210/170.01 |
| 6,516,578 | B1 * | 2/2003 | Hunsaker | E04F 13/0862 52/385 |
| 6,857,248 | B2 | 2/2005 | Ouellet | |
| 7,121,051 | B2 * | 10/2006 | Hunsaker | E04F 13/0862 52/314 |
| 7,703,251 | B2 | 4/2010 | Roh | |
| 7,779,591 | B2 | 8/2010 | Becker et al. | |
| 8,033,069 | B2 | 10/2011 | Hotchkiss, III | |
| 8,387,323 | B2 | 3/2013 | Mickelson | |
| 8,844,227 | B1 | 9/2014 | Ciuperca | |

(Continued)

*Primary Examiner* — Patrick J Maestri
(74) *Attorney, Agent, or Firm* — TraskBritt, P.C.

(57) ABSTRACT

An insulative assembly comprises an insulating structure exhibiting at least one groove extending partially therethrough, at least one supportive insert partially within the at least one groove, an adhesive overlying at least one surface of the insulative structure outside of the at least one groove, and at least one cladding structure over and in contact with the adhesive and the at least one supportive insert. A building structure and a method of forming a building structure are also described.

1 Claim, 3 Drawing Sheets

(56) References Cited

U.S. PATENT DOCUMENTS

| | | | |
|---|---|---|---|
| 9,027,302 | B2 | 5/2015 | Buoni et al. |
| 9,453,346 | B2 | 9/2016 | Yau |
| 9,528,274 | B2 | 12/2016 | Curtis |
| 2003/0066259 | A1 | 4/2003 | Sudweeks |
| 2007/0175139 | A1 | 8/2007 | Nicolson et al. |
| 2007/0209308 | A1 | 9/2007 | Barrett |
| 2009/0113837 | A1 | 5/2009 | Mickelson |
| 2014/0087158 | A1 | 3/2014 | Ciuperca |
| 2015/0275527 | A1 | 10/2015 | Porter |

* cited by examiner

METHOD OF FORMING A BUILDING STRUCTURE

CROSS-REFERENCE TO RELATED APPLICATION

This application claims the benefit of U.S. Provisional Patent Application Ser. No. 62/198,035, filed Jul. 28, 2015, the disclosure of which is hereby incorporated herein in its entirety by this reference.

FIELD

The disclosure, in various embodiments, relates generally to insulative assemblies, to building structures including the insulative assemblies, and to related methods. More specifically, embodiments of the disclosure relate to insulative assemblies including inserts configured and positioned to support cladding structures overlying insulating structures, to building structures including such insulative assemblies, and to related methods.

BACKGROUND

Cladding structures (e.g., bricks, slate, natural stone, simulated stone, tile, clay structures, wood structures, ceramic structures, polymeric structures, metallic structures, etc.) can be attached to one or more surface(s) of a structure (e.g., a building structure, such as a building wall) to provide the structure desirable properties, such as desirable aesthetic properties and/or desired structural properties. To improve the energy efficiency of the structure to be covered by the cladding structures, the cladding structures can be attached to insulative structures (e.g., insulative panels, such as polymeric foam panels) to form insulative assemblies, which may be secured (e.g., attached, coupled, etc.) to a surface of the structure.

Many cladding structures have conventionally been secured to structures (e.g., building walls, insulative panels, etc.) using at least one adhesive (e.g., an adhesive mortar). Unfortunately, the weight of some cladding structures can result in movement (e.g., settling, sliding, shifting, etc.) and/or detachment of the cladding structures before the adhesive completely cures, especially when environmental conditions (e.g., cold temperatures, moisture, etc.) prolong the cure time of the adhesive. To alleviate such problems, separate fixtures (e.g., clamps, through-bolts, metal lath, etc.) have been fastened to such structures (e.g., such building walls, such insulative panels, etc.) at predetermined locations and have then been used to hold and secure the cladding structures in position until the adhesive cures. However, such fixtures can require a significant amount of time and skilled labor to position and assemble on site, making it difficult to cover large areas of such structures with desired cladding structures in a simple, efficient, and cost-effective manner.

Accordingly, there remains a need for new structures, assemblies, and methods facilitating the simple and efficient means of securing one or more cladding structures to another structure.

BRIEF SUMMARY

In accordance with one embodiment described herein, an insulative assembly comprises an insulating structure exhibiting at least one groove extending partially therethrough, at least one supportive insert partially within the at least one groove, an adhesive overlying at least one surface of the insulative structure outside of the at least one groove, and at least one cladding structure over and in contact with the adhesive and the at least one supportive insert.

In additional embodiments, a building structure comprises a base structure and an insulative assembly attached to the base structure. The insulative assembly comprises an insulating structure exhibiting a substantially non-planar topography comprising elevated regions and recessed regions, supportive inserts partially disposed within grooves in the insulating structure at least partially defined by the elevated regions and the recessed regions of the insulating structure, an adhesive overlying surfaces of the elevated regions of the insulating structure, and cladding structures over and in contact with the adhesive and the supportive inserts.

In additional embodiments, a method of forming a building structure comprises forming an insulating structure exhibiting at least one groove extending partially therethrough. The insulating structure is attached to a base structure. A portion of at least one supportive insert is introduced into the at least one groove. An adhesive is formed over at least one surface of the insulative structure outside of the at least one groove. At least one cladding structure is provided over and in contact with the adhesive and the at least one supportive insert.

DETAILED DESCRIPTION

Figure 1:
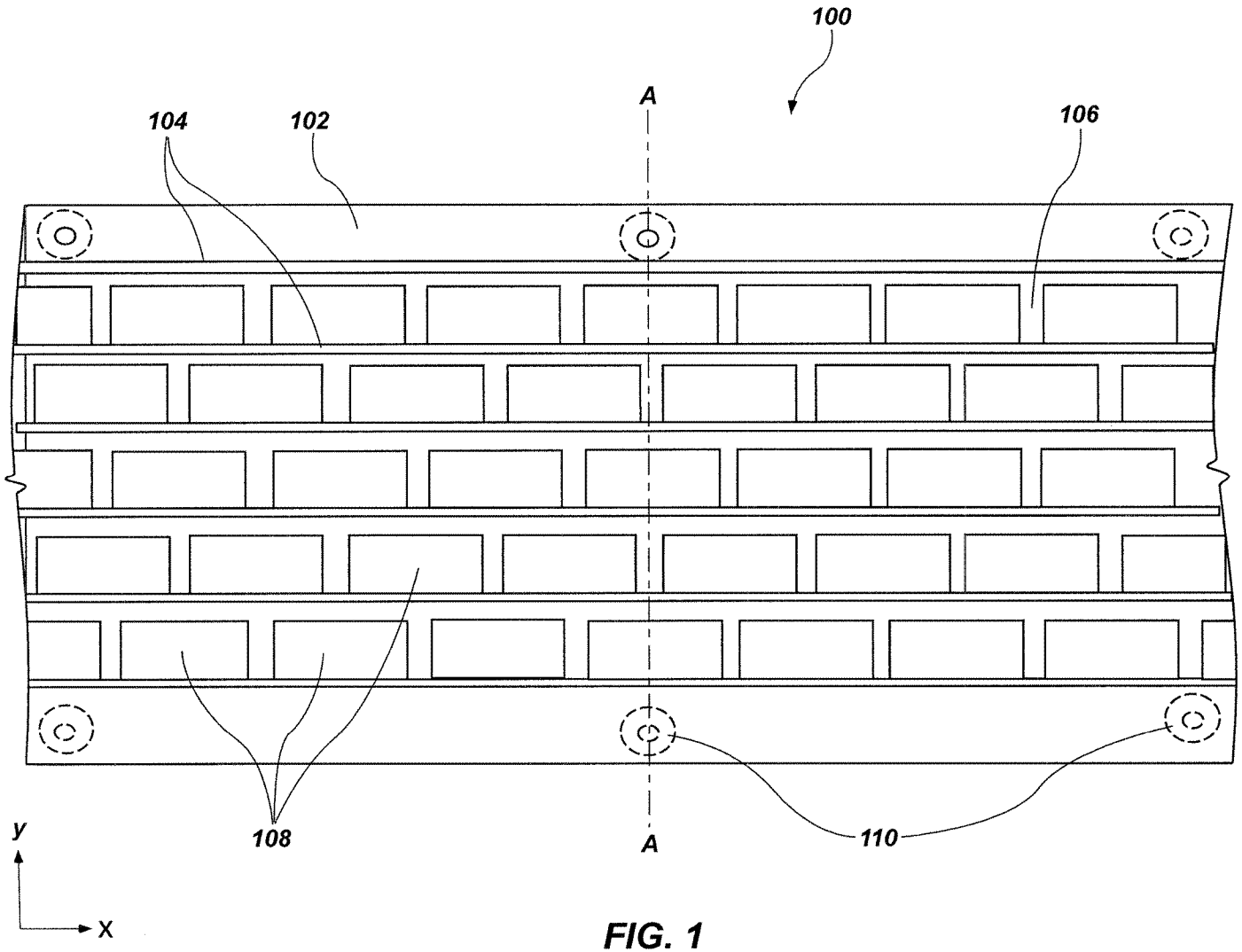
FIG. 1 is a longitudinal schematic view illustrating an insulative assembly, in accordance with an embodiment of disclosure.

Insulative assemblies are disclosed, as are building structures including the insulative assemblies, and related methods of forming the insulative assemblies and building structures. In some embodiments, an insulative assembly includes an insulating structure, at least one supportive insert embedded in and extending from the insulating structure, an adhesive overlying at least one surface of the insulative structure, and at least one cladding structure over and in contact with the adhesive and the at least one supportive insert. The at least one supportive insert may be partially retained in at least one groove in the insulating structure, and may be configured to maintain a position of the at least one cladding structure relative to the insulating structure. The structures, assemblies, and methods of the disclosure may provide one or more of enhanced efficiency, enhanced ease of formation, reduced costs, energy code compliance, and increased durability relative to conventional structures, assemblies, and methods associated with cladding (e.g., siding) operations.

The following description provides specific details, such as material compositions and processing conditions, in order to provide a thorough description of embodiments of the present disclosure. However, a person of ordinary skill in the art would understand that the embodiments of the disclosure may be practiced without employing these specific details. Indeed, the embodiments of the disclosure may be practiced in conjunction with conventional cladding structure fabrication techniques employed in the industry. In addition, the description provided below does not form a complete process flow for manufacturing an insulative assembly or building structure. Only those process acts and structures necessary to understand the embodiments of the disclosure are described in detail below. Additional acts to form a complete insulative assembly from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

Figure 2:
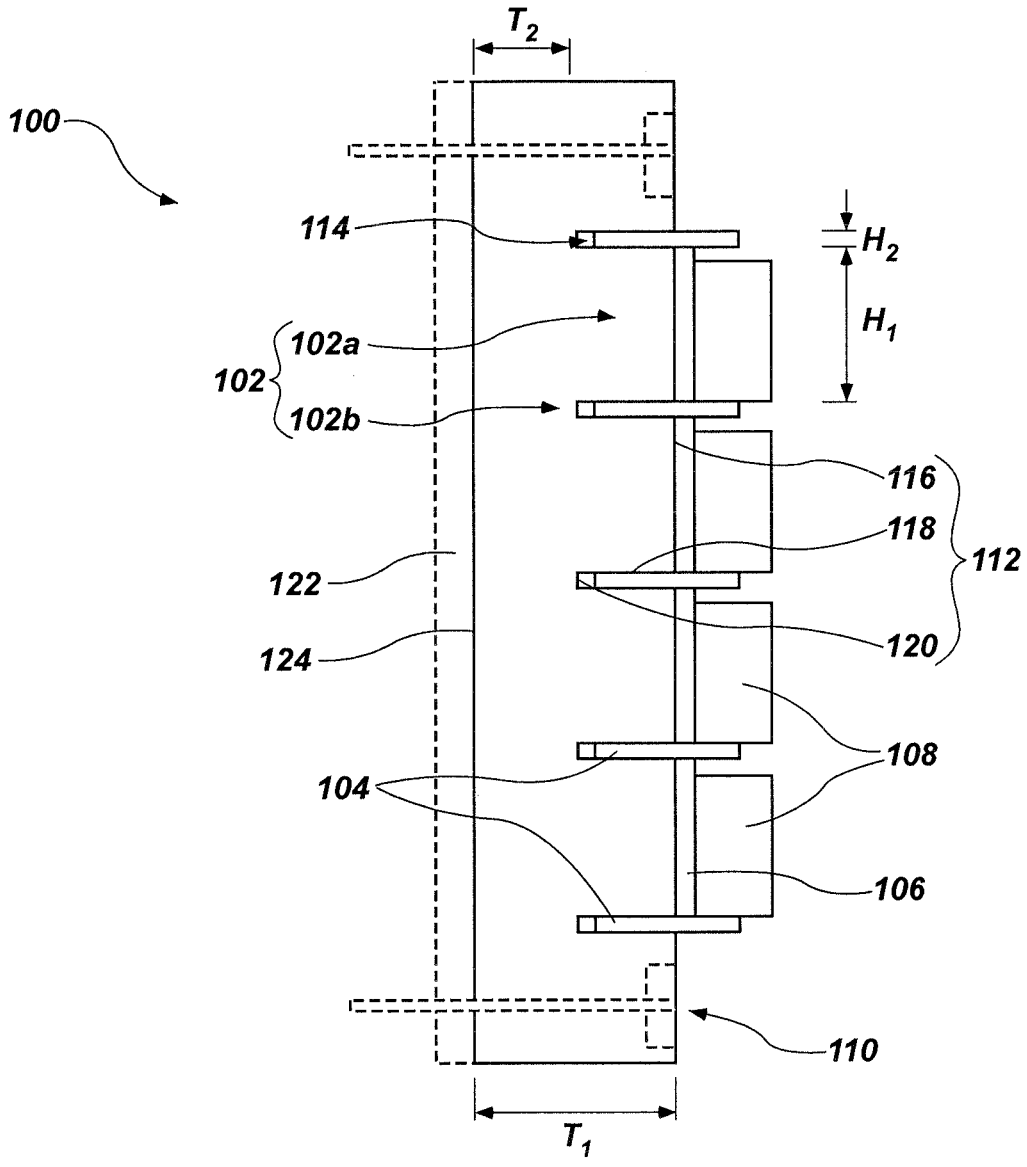
FIG. 2 is a transverse cross-sectional view of the insulative assembly shown in FIG. 1.

FIG. 1 is a longitudinal schematic view of an insulative assembly 100 in accordance with an embodiment of the disclosure. The insulative assembly 100 may include an insulating structure 102 (e.g., an insulating panel), supportive inserts 104 coupled to (e.g., attached to, embedded in, etc.) the insulating structure 102, an adhesive 106 on or over the insulating structure 102 and between the supportive inserts 104, and cladding structures 108 on or over the adhesive 106 and between the supportive inserts 104. The insulative assembly 100 may also include one or more of attachment structures 110 and an additional adhesive 122 (FIG. 2) for coupling the insulative assembly 100 to at least one other structure (e.g., a building structure, such as a building wall). The insulative assembly 100 may, for example, comprise an insulative assembly for one or more of an exterior and an interior of a building (e.g., a domestic building, a commercial building, etc.). FIG. 2 is a transverse cross-sectional view of the insulative assembly 100 depicted in FIG. 1 along the line A-A. While FIGS. 1 and 2 depict a particular configuration of the insulative assembly 100, one of ordinary skill in the art will appreciate that different insulative assembly configurations are known in the art, which may be adapted to be employed in embodiments of the disclosure. FIG. 1 illustrates just one non-limiting example of the insulative assembly 100.

Referring collectively to FIGS. 1 and 2, the insulating structure 102 may be formed of and include at least one thermally insulative material, such as an insulative foam material. Suitable insulative foam materials include, but are not limited to, closed-cell polymeric foam materials, such as expanded polystyrene foam (EPS) (e.g., molded expanded polystyrene foam, extruded expanded polystyrene foam, etc.), polyisocyanurate (PIR) foam, polyethylene foam, polyurethane foam, polypropylene foam, polyester foam, polyvinyl chloride foam, polyacrylonitrile foam, polyamide foam, polyimide foam, a fluoropolymers foam, a polysilicon foam, or combinations thereof. In some embodiments, the insulating structure 102 is formed of and includes EPS.

The insulating structure 102 may exhibit any desired peripheral geometric configuration (e.g., peripheral shape and peripheral size). The insulating structure 102 may, for example, exhibit a peripheral shape and a peripheral size permitting the insulating structure 102 to at least partially cover one or more of an exterior surface and an interior surface of a building. The insulating structure 102 may exhibit a peripheral shape and a peripheral size complementary to (e.g., substantially similar to) a shape and a size of at least a portion of the exterior surface and/or the interior surface of the building. In some embodiments, the insulating structure 102 exhibits a generally rectangular peripheral shape. In additional embodiments, the insulating structure 102 may exhibit a different peripheral shape (e.g., a circular shape; a semicircular shape; a crescent shape; an ovular shape; an annular shape; an astroidal shape; a deltoidal shape; an ellipsoidal shape; a triangular shape; a square shape; a trapezium shape; a trapezoidal shape; a parallelogram shape; a kite shape; a rhomboidal shape; a pentagonal shape; a hexagonal shape; a heptagonal shape; an octagonal shape; an enneagonal shape; a decagonal shape; truncated versions thereof; or an irregular shape, such as a complex shape complementary to an exterior of a building and/or an interior of a building).

As shown in FIG. 2, the insulating structure 102 exhibits a non-planar topography including elevated regions 102*a* and recessed regions 102*b* defining grooves 114 (e.g., trenches, openings, vias, indentations, etc.) in the insulating structure 102. The elevated regions 102*a* and the recessed regions 102*b* (and, hence, the grooves 114) at least partially define a major, non-planar surface 112 of the insulating structure 102. For example, as depicted in FIG. 2, the major, non-planar surface 112 of the insulating structure 102 may be formed of and include upper surfaces 116 of the elevated regions 102*a*, side surfaces 118 of the elevated regions 102*a*, and upper surfaces 120 of the recessed regions 102*b*. While various embodiments herein describe the insulating structure 102 as including elevated regions 102*a* (i.e., more than one elevated region 102*a*), recessed regions 102*b* (i.e., more than one recessed region 102*b*), and grooves 114 (i.e., more than one groove 114), the insulating structure 102 may, alternatively, include a single elevated region 102*a*, a single recessed region 102*b*, and/or a single groove 114.

The elevated regions 102*a* and the recessed regions 102*b* may each independently exhibit a desired geometric configuration (e.g., a desired size and a desired shape). For example, as shown in FIG. 2, each of the elevated regions 102*a* may exhibit a thickness $T_1$ and a height $H_1$, and each of the recessed regions 102*b* exhibit a relatively smaller thickness $T_2$ and a relatively smaller height $H_2$. In additional embodiments, at least one of the elevated regions 102*a* may exhibit a different geometric configuration (e.g., a different thickness, a different height, and/or a different shape) than at least one other of the elevated regions 102*a*, and/or at least one of the recessed regions 102*b* may exhibit a different geometric configuration (e.g., a different thickness, a different height, and/or a different shape) than at least one other of the recessed regions 102*b*. The geometric configurations of the elevated regions 102*a* and the recessed regions 102*b* may at least partially depend on desired geometric configurations of the grooves 114. The geometric configurations of the grooves 114 may be selected to facilitate the at least temporary retention of the supportive inserts 104 therein. For example, each of the grooves 114 may independently exhibit a shape complementary to a shape of one or more of the supportive inserts 104 to be at least temporarily retained therein, and a size facilitating such retention. In some embodiments, each of the grooves 114 independently exhibits a substantially rectangular shape having a height (e.g., corresponding to the height $H_2$ of the recessed regions 102*b*) slightly smaller than a height of the supportive inserts 104 partially retained therein. In additional embodiments, one or more of the grooves 114 may exhibit at least one of a different shape (e.g., a different rectangular shape, a non-rectangular shape, etc.) and a different size.

The grooves 114 (and, hence, the elevated regions 102*a* and the recessed regions 102*b*) may extend in at least one of substantially linear paths and substantially non-linear paths across the major, non-planar surface 112 of the insulating structure 102. In some embodiments, each of the grooves 114 extends in a substantially linear path across the major, non-planar surface 112. In additional embodiments, at least one of the grooves 114 extends in a substantially non-linear path (e.g., a V-shaped path, a U-shaped path, an angled path, a jagged path, a sinusoidal path, a curved path, an irregularly shaped path, or a combination thereof) across the major, non-planar surface 112, and at least one other of the grooves 114 extends in a substantially linear path across the major, non-planar surface 112. In further embodiments, each of the grooves 114 extends in a substantially non-linear path across the major, non-planar surface 112. In embodiments wherein the grooves 114 extend in multiple non-linear paths (e.g., at least two non-linear paths) across the major, non-planar surface 112 of the insulating structure 102, the shape of each of the non-linear paths may be substantially the same, or the shape of at least one of the non-linear paths may be different than the shape of at least one other of the non-linear paths.

Each of the grooves 114 (and, hence, each of the elevated regions 102*a* and each of the recessed regions 102*b*) may extend substantially continuously across the major, non-planar surface 112 of the insulating structure 102, or may extend discontinuously (e.g., as sections spaced apart from one another in the x direction depicted in FIG. 1) across the major, non-planar surface 112 of the insulating structure 102. In some embodiments, each of the grooves 114 extends substantially continuously across the major, non-planar surface 112. In additional embodiments, at least one of the grooves 114 extends substantially continuously across the major, non-planar surface 112, and at least one other of the grooves 114 extends discontinuously across the major, non-planar surface 112. In further embodiments, each of the grooves 114 extends discontinuously across the major, non-planar surface 112. In embodiments wherein a plurality of the grooves 114 extends discontinuously across the major, non-planar surface 112 of the insulating structure 102, the characteristics (e.g., segment lengths, segment spacing, etc.) of each of the plurality of the grooves 114 may be substantially the same, or at least one of the plurality of the grooves 114 may exhibit different characteristics (e.g., different segment lengths, different segment spacing, etc.) than at least one other of the plurality of the grooves 114.

As illustrated in FIG. 2, in some embodiments, each of the grooves 114 is set apart from each adjacent groove 114 by substantially the same distance (e.g., corresponding to the height $H_1$ of the each of the elevated regions 102*a*), such that the grooves 114 are uniformly spaced. In additional embodiments, at least one of the grooves 114 is set apart from an adjacent groove 114 by a different distance than that between the at least one of the grooves 114 and another adjacent groove 114, such that the grooves 114 are non-uniformly spaced. The distance between adjacent grooves 114 may at least partially depend on the size (e.g., height) of the cladding structures 108 provided between the supportive inserts 104 retained within the adjacent grooves 114, as described in further detail below.

With continued reference to FIGS. 1 and 2, the supportive inserts 104 are positioned (e.g., longitudinally positioned, laterally positioned, etc.) and configured (e.g., materially composed, sized, shaped, etc.) to support the weight of the cladding structures 108 and to maintain the positions of the cladding structures 108 at least for a sufficient period of time for the adhesive 106 provided between the cladding structures 108 and the insulating structure 102 to cure. The supportive inserts 104 may prevent undesirable movement and/or detachment of the cladding structures 108 that may otherwise occur if the supportive inserts 104 were absent from (e.g., not included in) the insulative assembly 100.

Each of the supportive inserts 104 may independently be formed of and include a material capable of a retaining the supportive insert 104 and the cladding structures 108 adjacent thereto (e.g., in physical contact therewith) in position relative to one or more portions (e.g., the upper surfaces 116 of the elevated regions 102*a*) of the major, non-planar surface 112 of the insulating structure 102. For example, each of the supportive inserts 104 may independently be formed of and include at least one of a metal material (e.g., a metal, a metal alloy, etc.), a polymer material (e.g., a plastic), and a ceramic material. In some embodiments, each of the supportive inserts 104 is independently formed of and includes at least one of a metal and a metal alloy (e.g., steel).

As shown in FIG. 2, portions of the supportive inserts 104 are retained within the grooves 114 in the insulating structure 102, and other portions of the supportive inserts 104 protrude (e.g., project, extend, etc.) beyond boundaries of the grooves 114 (e.g., beyond the upper surfaces 116 of the elevated regions 102*a*) in the insulating structure 102. The depth to which each of the supportive inserts 104 extends within the groove 114 associated therewith at least partially depends on the configuration (e.g., material composition, size, shape, etc.) and position of the supportive insert 104, on the configuration and position of each other of the supportive inserts 104, and on the configurations and positions of the portions of the insulating structure 102, the adhesive 106, and the cladding structures 108 adjacent thereto. The supportive inserts 104 may independently extend to one or more depths within the groove 114 in the insulating structure 102 ensuring that the supportive inserts 104 will not undesirably separate (e.g., detach, dislodge, etc.) from the insulating structure 102 during use and operation of the insulative assembly 100. For example, each of the supportive inserts 104 may independently extend at least about 50 percent (e.g., at least about 66 percent, at least about 75 percent, at least about 90 percent, about 100 percent) of the way through the groove 114 in the insulating structure 102 associated therewith. In some embodiments, the supportive inserts 104 extend about 100 percent of the way through the grooves 114 associated therewith to physically contact the upper surfaces 120 of the recessed regions 102*b* of the insulating structure 102. In additional embodiments, one or more of the supportive inserts 104 may be offset from (e.g., spaced apart from, not in physical contact with, etc.) the upper surfaces 120 of the recessed regions 102*b* of the insulating structure 102 adjacent thereto. Depending on the configurations of the grooves 114, each of the supportive inserts 104 may independently extend up to about 75 percent (e.g., up to about 50 percent, up to about 33 percent, up to about 25 percent) of the way through a maximum thickness (e.g., the thickness $T_1$ of the elevated regions 102*a*) of the insulating structure 102.

All the supportive inserts 104 may extend to substantially the same depth within the insulating structure 102 (e.g., to substantially the same depth within the grooves 114), or at least one of the supportive inserts 104 may extend to a different depth within the insulating structure 102 than at least one other of the supportive inserts 104. For example, a first of the supportive inserts 104 may extend to a shallower depth within the insulating structure 102 (e.g., a shallower depth with one of the grooves 114) than a second of the supportive inserts 104 (i.e., the second of the supportive inserts 104 may extend deeper into the insulating structure 102 than the first of the supportive inserts 104). The first of the supportive inserts 104 and the second of the supportive inserts 104 may be located in the same groove 114 in the insulating structure 102, or may be located in different grooves 114 in the insulating structure 102. In some embodiments, each of the supportive inserts 104 extends to substantially the same depth within the insulating structure 102.

Each of the supportive inserts 104 may independently exhibit a shape and a size configured to retain the supportive insert 104 within the groove 114 associated therewith, and to retain the cladding structures 108 associated therewith (e.g., adjacent thereto, in physical contact therewith) in position relative to one or more portions (e.g., the upper surfaces 116 of the elevated regions 102*a*) of the major, non-planar surface 112 of the insulating structure 102. For example, as shown in FIGS. 1 and 2, one or more of the supportive inserts 104 may comprise an elongate rectangular structure extending at least partially (e.g., substantially) into a maximum depth of the groove 114 associated therewith, and at least partially (e.g., substantially) across a total length of the groove 114 associated therewith. In additional embodiments, one or more of the supportive inserts 104 may exhibit at least one of a different shape and a different size capable of retaining the supportive insert 104 within the groove 114 and of retaining the cladding structures 108 associated therewith in position. Portions of the supportive inserts 104 within the grooves 114 may abut (e.g., physically contact) one or more surfaces of the elevated regions 102*a* of the insulating structure 102 defining the grooves 114. For example, portions of the supportive inserts 104 within the grooves 114 may physically contact the side surfaces 118 of the elevated regions 102*a* of the insulating structure 102, and, optionally, may also contact the upper surfaces 120 of the recessed regions 102*b* of the insulating structure 102. The shape and the size of each of the supportive inserts 104 may permit the supportive insert 104 to be retained within the groove 114 associated therewith without use of an adhesive material. The supportive inserts 104 may, for example, be shaped and sized relative to the grooves 114 to be frictionally retained within the grooves 114. In some embodiments, one or more of the supportive inserts 104 may exhibit at least one textured (e.g., grooved, ringed, threaded, spiraled, notched, barbed, etc.) surface. The textured surface may assist with securing the supportive insert 104 within the associated groove 114 in the insulating structure 102. In additional embodiments, each of the supportive inserts 104 only exhibits substantially smooth (e.g., substantially non-textured) surfaces.

Each of the supportive inserts 104 may be substantially the same, or at least one of the supportive inserts 104 may be different than at least one other of the supportive inserts 104. For example, each of the supportive inserts 104 may have substantially the same shape, size, and material composition, or at least one of the supportive inserts 104 may have a different shape, a different size, and/or a different material composition than at least one other of the supportive inserts 104. In some embodiments, each of the supportive inserts 104 is substantially the same as each other of the supportive inserts 104. In additional embodiments, each of the supportive inserts 104 exhibits substantially the same material composition, but at least one of the supportive inserts 104 exhibits a different size and/or a different shape than at least one other of the supportive inserts 104. In further embodiments, each of the supportive inserts 104 exhibits substantially the same shape, but at least one of the supportive inserts 104 exhibits a different material composition and/or a different size than at least one other of the supportive inserts 104. In yet further embodiments, each of the supportive inserts 104 exhibits a different shape, a different size, and a different material composition than each other of the supportive inserts 104.

The supportive inserts 104 may extend in paths complementary to the paths of the grooves 114 in the insulating structure 102 in which the supportive inserts 104 are disposed (e.g., located, positioned, provided, etc.). Accordingly, the supportive inserts 104 may extend in at least one of substantially linear paths and substantially non-linear paths across the major, non-planar surface 112 of the insulating structure 102. In some embodiments, each of the supportive inserts 104 extends in a substantially linear path across the major, non-planar surface 112. In additional embodiments, at least one of the supportive inserts 104 extends in a substantially non-linear path (e.g., a V-shaped path, a U-shaped path, an angled path, a jagged path, a sinusoidal path, a curved path, an irregularly shaped path, or a combination thereof) across the major, non-planar surface 112, and at least one other of the supportive inserts 104 extends in a substantially linear path across the major, non-planar surface 112. In further embodiments, each of the supportive inserts 104 extends in a substantially non-linear path across the major, non-planar surface 112. In embodiments wherein the supportive inserts 104 extend in multiple non-linear paths (e.g., at least two non-linear paths) across the major, non-planar surface 112 of the insulating structure 102, the shape of each of the non-linear paths may be substantially the same, or the shape of at least one of the non-linear paths may be different than the shape of at least one other of the non-linear paths.

Each of the grooves 114 in the insulating structure 102 may retain a single supportive insert 104, or at least one of the grooves 114 in the insulating structure 102 may retain multiple supportive inserts 104. If a groove 114 retains a single supportive insert 104, the supportive insert 104 may extend across an entire length of the groove 114, or may extend across less than an entire length of the groove 114. If a groove 114 retains multiple supportive inserts 104, each of the supportive inserts 104 within may be spaced apart (e.g., uniformly spaced apart, non-uniformly spaced apart, etc.) from one another, or one or more of the supportive inserts 104 may physically contact one another. In some embodiments, each of the grooves 114 retains a single supportive insert 104 extending across an entire length of the groove 114. In additional embodiments, at least one of the grooves 114 retains multiple supportive inserts 104, which together extend (with or without spacing between adjacent supportive inserts 104) across an entire length of the at least one of the grooves 114.

The insulative assembly 100 may be formed of and include any quantity and any distribution (e.g., pattern) of the supportive inserts 104 facilitating the retention of the cladding structures 108 in desired positions relative to the major, non-planar surface 112 of the insulating structure 102. The quantity and the distribution of the supportive inserts 104 may at least partially depend on the configurations (e.g., material compositions, shapes, sizes, etc.) of the insulating structure 102, the adhesive 106, and the cladding structures 108. The supportive inserts 104 may be symmetrically distributed across the insulating structure 102, or may be asymmetrically distributed across the insulating structure 102. In addition, while various embodiments herein describe the insulative assembly 100 as including multiple supportive inserts 104 (i.e., more than one supportive insert 104), the insulative assembly 100 may, alternatively, include a single supportive insert 104 embedded in and protruding from the insulating structure 102 at a desired position along the insulating structure 102.

The adhesive 106 may be formed of at least one material formulated and positioned to adhere (e.g., couple, bond, etc.) the insulating structure 102 and the cladding structures 108 to one another. The adhesive 106 may be selected at least partially based on the material compositions of the insulating structure 102, the supportive inserts 104, and the cladding structures 108 adjacent thereto. The adhesive 106 may be compatible with each of the insulating structure 102, the supportive inserts 104, and the cladding structures 108 thereto. As used herein, the term "compatible" means that a material does not undesirably react, decompose, or absorb another material, and also that the material does not undesirably impair the chemical and/or mechanical properties of the another material. By way of non-limiting example, the adhesive 106 may comprise at least one of a polymeric adhesive material, a cementisious adhesive material, thinset cement (e.g., adhesive mortar) material, an acrylic adhesive material, a silicone adhesive material, an epoxy adhesive material. In some embodiments, the adhesive 106 comprises thinset cement. The adhesive 106 may be formulated and positioned to adhere the cladding structures 108 to the insulating structure 102 without substantially impeding or preventing removal of the supportive inserts 104 from the grooves 114 in the insulating structure 102, or may be formulated and positioned to adhere the cladding structures 108 and one or more the supportive inserts 104 to the insulating structure 102.

Each of the cladding structures 108 may be configured at least partially based on the configurations of each other of the cladding structures 108 to provide the insulative assembly 100 with desired properties (e.g., aesthetic properties, structural properties, etc.). For example, each of the cladding structures 108 may be configured and positioned relative to each other of the cladding structures 108 to facilitate the formation of a façade that resembles (e.g., imitates, simulates, emulates, etc.) a wall formed of and including brick, slate, natural stone, simulated stone, tile, wood structures, ceramic structures, polymeric (e.g., plastic) structures, and/or metallic structures.

The cladding structures 108 may each independently be formed of and include a material suitable for use as a siding (e.g., an exterior siding, an interior siding) for at least one of a building (e.g., a domestic building, a commercial building, etc.) and an interior structure (e.g., hearth, mantle, backsplash, etc.) of a building. The cladding structures 108 may, for example, be formed of and include a composite material including a cement matrix, aggregate (e.g., rock, gravel, sand, crushed fines, etc.), and, optionally, one or more additional materials (e.g., pigments, curatives, hardeners, other additives, etc.). The composite material may comprise a relatively light density (e.g., within a range of from about 1 pound per square foot to about 30 pounds per square foot) cement aggregate material. In some embodiments, at least some of the cladding structures 108 comprise simulated stone structures each independently comprising a concrete material including a hydraulic binder and at least one aggregate material. In additional embodiments, at least some of the cladding structures 108 comprise clay structures, such as brick. In further embodiments, at least some of the cladding structures 108 comprise one or more of slate, natural stone, tile, wood structures, ceramic structures, polymeric (e.g., plastic) structures, and metallic structures.

The cladding structures 108 may each independently exhibit any desired geometric configuration (e.g., shape and size). Each of the cladding structures 108 may, for example, independently exhibit a shape and a size suitable for an exterior building application and/or as an interior building application. By way of non-limiting example, referring collectively to FIGS. 1 and 2, the cladding structures 108 may exhibit one or more generally rectangular shapes. In additional embodiments, one or more of the cladding structures 108 may exhibit a different shape, such as a conical shape, a pyramidal shape, a cubic shape, a cuboidal shape, a spherical shape, a hemispherical shape, a cylindrical shape, an annular shape, a semi-cylindrical shape, truncated versions thereof (e.g., a frusto-conical shape), or an irregular shape. Irregular shapes include complex shapes, such as complex shapes exhibited by natural stone. As shown in FIG. 2, adjacent cladding structures 108 may be sized, shaped, and spaced relative to one another to permit the deposition of another material (e.g., mortar) between the adjacent cladding structures 108.

Each of the cladding structures 108 may be substantially the same, or at least one of the cladding structures 108 may be different than at least one other of the cladding structures 108. For example, each of the cladding structures 108 may have substantially the same shape, size, and material composition, or at least one of the cladding structures 108 may have a different shape, a different size, and/or a different material composition than at least one other of the cladding structures 108. In some embodiments, each of the cladding structures 108 is substantially the same as each other of the cladding structures 108. In additional embodiments, at least one of the cladding structures 108 may be different than (e.g., exhibit a different shape, a different size, and/or a different material composition) than at least one other of the cladding structures 108.

The insulative assembly 100 may exhibit any quantity and any distribution (e.g., pattern) of the cladding structures 108. The quantity and the distribution of the cladding structures 108 may at least partially depend on the configuration (e.g., material composition, shape, size, etc.) of the insulating structure 102. The cladding structures 108 may be symmetrically distributed across the insulating structure 102, or may be asymmetrically distributed across the insulating structure 102. In some embodiments, the cladding structures 108 are asymmetrically distributed across the insulating structure 102. In addition, while various embodiments herein describe the insulative assembly 100 as including multiple cladding structures 108 (i.e., more than one cladding structure 108), the insulative assembly 100 may, alternatively, include a single cladding structure 108 attached to the insulating structure 102 at a desired position along the insulating structure 102.

With continued reference to FIGS. 1 and 2, the insulative assembly 100 may include one or more of the additional adhesive 122 and the attachment structures 110. The additional adhesive 122 and/or the attachment structures 110 may be configured and positioned to facilitate or assist in attaching (e.g., coupling, affixing, bonding, etc.) the insulative assembly 100 to an additional structure (e.g., a building structure, such as an external structure of a building, an internal structure of a building, etc.). In some embodiments, the insulative assembly 100 includes the additional adhesive 122, but not the attachment structures 110. In additional embodiments, the insulative assembly 100 includes the attachment structures 110, but not the additional adhesive 122. In further embodiments, the insulative assembly 100 includes the additional adhesive 122 and the attachment structures 110.

If present, the additional adhesive 122 may be positioned and formulated to attach (e.g., adhere, couple, bond, etc.) the insulating structure 102 to one or more portions of the additional structure. The additional adhesive 122 may be positioned and formulated to retain the insulative assembly 100 in position relative to the one or more portions of the additional structure. The position(s) and formulation(s) of the additional adhesive 122 may at least partially depend on the configurations and positions of the other components (e.g., the insulating structure 102, the supportive inserts 104, the adhesive 106, the cladding structures 108, the attachment structures 110 (if any), etc.) of the insulative assembly 100, and on the configuration of the additional structure to which the insulative assembly 100 is to be attached. As shown in FIG. 2, if present, the additional adhesive 122 may be provided on or over at least a portion of a major, planar surface 124 to be positioned adjacent a surface of the additional structure (e.g., such that the additional adhesive 122 at least partially intervenes between the major, planar surface 124 and the surface of the additional structure). The additional adhesive 122 may be compatible with the material compositions of the insulating structure 102 and the additional structure. By way of non-limiting example, depending of the material compositions of the insulating structure 102 and the additional structure, the additional adhesive 122 may comprise at least one of a polymeric adhesive material, a cementisious adhesive material, thinset cement (e.g., adhesive mortar) material, an acrylic adhesive material, a silicone adhesive material, an epoxy adhesive material. In some embodiments, the additional adhesive 122 comprises thinset cement.

If present, the attachment structures 110 may each independently exhibit a configuration (e.g., size, shape, material composition, etc.) and position capable of attaching the insulative assembly 100 to one or more portions of the additional structure. The attachment structures 110 may be configured and positioned to retain the insulative assembly 100 in position relative to the one or more portions of the additional structure. The configuration and position of each of the attachment structures 110 may at least partially depend on the configurations and positions of each other of the attachment structures 110, on the configurations and positions of the other components (e.g., the insulating structure 102, the supportive inserts 104, the adhesive 106, the cladding structures 108, the additional adhesive 122 (if any), etc.) of the insulative assembly 100, and on the configuration of the additional structure to which the insulative assembly 100 is to be attached. In some embodiments, the insulating structure 102 of the insulative assembly 100 exhibits at least one of the attachment structures 110 proximate one or more (e.g., each) of the peripheral corners thereof, the attachment structures 110 are each independently sized and shaped to extend through and project from the insulating structure 102, and the attachment structures 110 are each independently formed of and include one or more of a metal material (e.g., a metal, a metal alloy, etc.), a polymer material (e.g., a plastic), and a ceramic material. If present, the attachment structures 110 may be symmetrically distributed across the insulating structure 102, or may be asymmetrically distributed across the insulating structure 102. In addition, while various embodiments herein describe the insulative assembly 100 as including multiple attachment structures 110 (i.e., more than one attachment structure 110), the insulative assembly 100 may, alternatively, include a single attachment structure 110 at a desired position along the insulating structure 102.

Figure 3:
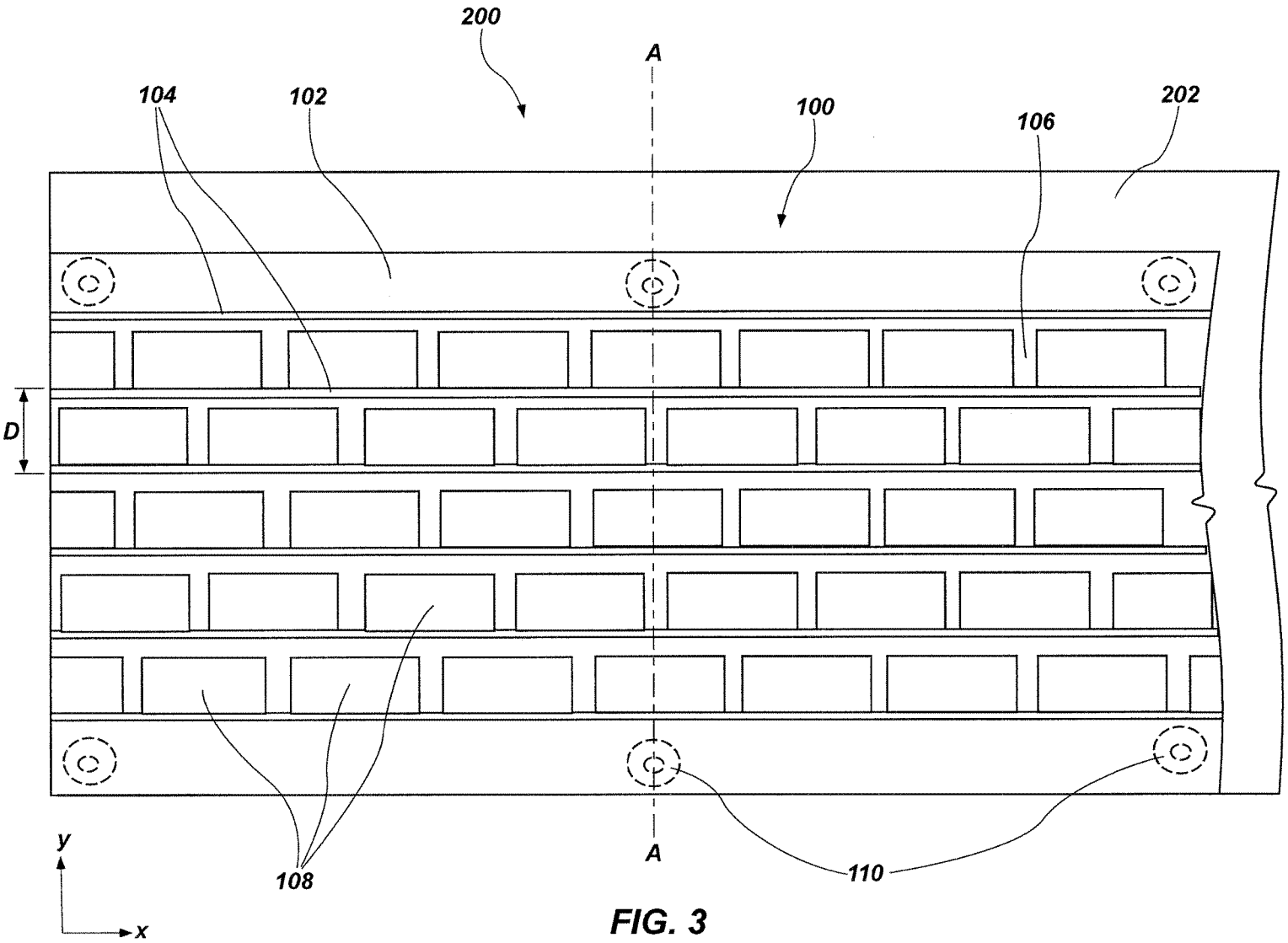
FIG. 3 is a longitudinal schematic view illustrating a building structure including the insulative assembly shown in FIG. 1, in accordance with an embodiment of disclosure.

FIG. 3 is a longitudinal schematic view of a building structure 200, in accordance with an embodiment of the disclosure. The building structure 200 includes at least one base structure 202, and the insulative assembly 100 previously described with respect to FIGS. 1 and 2 on or over the base structure 202. The base structure 202 may, for example, comprise a wall (e.g., an external wall, an internal wall, etc.) of the building structure 200. The base structure 202 may exhibit any desired configuration (e.g., material composition, shape, size, etc.), such as a configuration providing the building structure 200 with one or more desired structural properties (e.g., dimensions, strength, stiffness, etc.). The insulative assembly 100 may exhibit a peripheral shape and a peripheral size complementary to the base structure 202, and may be attached to the base structure 202 by way of the attachment structures 110 of the insulative assembly 100. The attachment structures 110 may extend into base structure 202 to secure the insulative assembly 100 to the base structure 202. The insulative assembly 100 may serve as an insulative façade for the building structure 200. While FIG. 3 depicts a particular configuration of the building structure 200, one of ordinary skill in the art will appreciate that different building structure configurations are known in the art which may be adapted to be employed in embodiments of the disclosure. FIG. 3 illustrates just one non-limiting example of the building structure 200.

As described in further detail below, the building structure 200 may be fabricated (e.g., manufactured, formed, produced, etc.) by forming the insulating structure 102, attaching the insulating structure 102 to the base structure 202, introducing the supportive inserts 104 into the grooves 114 (FIG. 2) in the insulating structure 102, forming the adhesive 106 on or over portions (e.g., the upper surfaces 116 of the elevated regions 102*a* shown in FIG. 2) of the major, non-planar surface 112 (FIG. 2) of the insulating structure 102, positioning the cladding structures 108 adjacent the insulating structure 102 and the supportive inserts 104, pressing the cladding structures 108 into the adhesive 106, and then substantially curing the adhesive 106. With the description as provided below, it will be readily apparent to one of ordinary skill in the art that the method described herein may be used in various applications. In other words, the method may be used whenever it is desired to form a structure (e.g., the building structure 200 shown in FIG. 3) exhibiting a desired configuration (e.g., desired components, desired component arrangements, desired material compositions, desired shapes, desired sizes, etc.).

The insulating structure 102 may be formed by forming the grooves 114 (FIG. 2) in a preliminary insulating structure exhibiting a desired peripheral size and a desired peripheral shape. The preliminary insulating structure may be formed using conventional processes (e.g., extrusion processes, molding processes, cutting processes, shearing processes, etc.) and conventional processing equipment, which are not described in detail herein. The grooves 114 may also be formed and spaced using conventional processes (e.g., material removal processes, such as hot wire processes, etching processes, routing processes, etc.) and conventional processing equipment, which are also not described in detail herein. In some embodiments, the grooves 114 are formed in the insulating structure 102 by contacting predetermined locations across the preliminary insulating structure with a heated structure (e.g., a heated heating element, a heated wire, etc.). One or more of an automated process (e.g., a process utilizing one or more apparatuses under computer number control) and a non-automated process (e.g., a manual process) may be used to form the insulating structure 102.

Next, the insulating structure 102 may be positioned at a predetermined location along the base structure 202, and may be secured (e.g., attached) to the base structure 202 using the attachment structures 110. At least a portion of the attachment structures 110 may be provided (e.g., driven, forced, pushed, etc.) through the insulating structure 102 and at least partially into the base structure 202. The attachment structures 110 may each independently be provided into the base structure 202 to any depth permitting the insulating structure 102 to remain attached to the base structure 202. Providing the attachment structures 110 into the base structure 202 may form openings in the base structure 202 substantially filled by the attachment structures 110.

After attaching the insulating structure 102 to the base structure 202, the supportive inserts 104 may be positioned relative to one or more locations along the grooves 114 (FIG. 2) in the insulating structure 102, and pressure may be applied to the supportive inserts 104 to drive portions of the supportive inserts 104 into the grooves 114. The supportive inserts 104 may each independently be provided (e.g., driven, forced, pushed, etc.) into one or more of the grooves 114 to any depth permitting the supportive inserts 104 and the cladding structures 108 to remain attached to the insulating structure 102 during subsequent curing of the adhesive 106 (described in further detail below). Providing the supportive inserts 104 into the grooves 114 in the insulating structure 102 may at least partially (e.g., substantially) fill the grooves 114 in the insulating structure 102.

Next, the adhesive 106 may be formed on or over at least one of the major, non-planar surface 112 (FIG. 2) of the insulating structure 102 and surfaces of the cladding structures 108. In some embodiments, the adhesive 106 is formed on the major, non-planar surface 112 of the insulating structure 102, but is not formed on surfaces of the cladding structures 108. The adhesive 106 may, for example, be formed on at least a portion of the upper surface 116 (FIG. 2) of each of the elevated regions 102*a* (FIG. 2) of the insulating structure 102. In additional embodiments, the adhesive 106 is formed on surfaces of the cladding structures 108, but is not formed on the major, non-planar surface 112 of the insulating structure 102. In additional embodiments, the adhesive 106 is formed on the major, non-planar surface 112 of the insulating structure 102 and on surfaces of the cladding structures 108. In such embodiments, the adhesive 106 may be formed on the major, non-planar surface 112 of the insulating structure 102 and on the surfaces of the cladding structures 108 simultaneously, sequentially, or a combination thereof. The adhesive 106 may be formed on or over major, non-planar surface 112 of the insulating structure 102 and/or on or over surfaces of the cladding structures 108 using at least one conventional deposition process. Suitable deposition processes include, but are not limited to, trowelling, spin coating, spray coating, brush coating, dip coating, immersion, soaking, and steeping. In some embodiments, the adhesive 106 is trowelled on or over at least one of the major, non-planar surface 112 of the insulating structure 102 and surfaces of the cladding structures 108.

Next, the cladding structures 108 may be positioned relative to one or more locations over the adhesive 106, and pressure may be applied to the cladding structures 108 to bring portions of the cladding structures 108 into physical contact with the adhesive 106 and form a preliminary insulative assembly. The cladding structures 108 may be provided at any desired locations relative to one another along the adhesive 106 (and, hence, along portions of the insulating structure 102 upon which the adhesive 106 is formed). In addition, the cladding structures 108 may physically contact one or more of the supportive inserts 104. The supportive inserts 104 may at least partially (e.g., substantially) maintain the positions of at least a portion (e.g., each) of the cladding structures 108 as the adhesive 106 cures.

After forming the preliminary insulative assembly, the preliminary insulative assembly may be subjected to at least one curing process to form the insulative assembly 100. The curing process may include subjecting the preliminary insulative assembly to one or more environmental conditions (e.g., temperatures, pressures, etc.) for a sufficient period of time to cure the adhesive 106. The curing process may enhance the bond strength between the insulating structure 102 and the cladding structures 108. In some embodiments, the curing process is performed under ambient environmental conditions (e.g., ambient temperatures and ambient pressures).

Following formation, the insulative assembly 100 may be subjected to additional processing, as desired. For example, in some embodiments, one or more (e.g., each) of the supportive inserts 104 are removed from the grooves 114 in the insulating structure 102, and an additional material (e.g., mortar) is formed in spaces between adjacent cladding structures 108. In additional embodiments, the supportive inserts 104 are maintained within (e.g., are not removed from) the grooves 114 in the insulating structure 102, and the additional material (e.g., mortar) is formed in the spaces between adjacent cladding structures 108.

The structures and methods of the disclosure may facilitate the fast, simple, and cost-effective production and customization of insulative assemblies for a wide variety of structures (e.g., buildings, such as domestic buildings and/or commercial buildings). For example, the supportive inserts and methods of the disclosure may provide a simple means of mitigating or even preventing undesirable movement of one of more components (e.g., cladding structures) of an insulative assembly during formation and/or use of the insulative assembly relative to conventional structures and methods. Embodiments of the disclosure may be used to quickly and reliably form an insulative assembly from an insulating structure and various cladding structures. The insulative assemblies and methods of the disclosure may improve the manufacturability and durability of a wide variety of building structures as compared to conventional insulative assemblies and methods.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents.

What is claimed is:

1. A method of forming a building structure, comprising:

forming an insulating structure exhibiting at least one rectangular groove extending partially therethrough;

attaching the insulating structure to a base structure;

introducing a portion of at least one rectangular supportive insert into the at least one rectangular groove;

placing an adhesive over at least one surface of the insulative structure outside of the at least one rectangular groove;

providing at least one cladding structure over and in contact with the adhesive and the at least one rectangular supportive insert;

removing the at least one rectangular supportive insert from the at least one rectangular groove after the adhesive has cured; and placing mortar in spaces between adjacent cladding structures after removing the at least one rectangular supportive insert from the at least one rectangular groove.

* * * * *